US006502439B1

(12) United States Patent
Stirling et al.

(10) Patent No.: US 6,502,439 B1
(45) Date of Patent: Jan. 7, 2003

(54) STORAGE LOCK MECHANISM

(75) Inventors: Mike Stirling, Spring Lake, MI (US); Ralph Russo, Whitehall, MI (US)

(73) Assignee: Herman Miller, Inc., Zeeland, MI (US)

( * ) Notice: Subject to any disclaimer, the term of this patent is extended or adjusted under 35 U.S.C. 154(b) by 38 days.

(21) Appl. No.: 09/587,776

(22) Filed: Jun. 6, 2000

Related U.S. Application Data

(60) Provisional application No. 60/138,122, filed on Jun. 7, 2000.

(51) Int. Cl.[7] ..... E05B 9/08

(52) U.S. Cl. ..... 70/370; 70/80; 70/81; 70/83; 70/357; 70/360; 70/361; 70/367; 70/371; 70/447; 70/448; 70/451; 70/452

(58) Field of Search ..... 70/370, 357, 360, 70/361, 367, 371, 80, 81, 83, 451, 447, 448, 452

(56) References Cited

U.S. PATENT DOCUMENTS

| | | | | | |
|---|---|---|---|---|---|
| 946,523 | A | * | 1/1910 | Thomas | 70/492 |
| 1,327,426 | A | | 1/1920 | Erickson | |
| 1,561,254 | A | * | 11/1925 | Ledin | 70/370 |
| 2,025,390 | A | | 12/1935 | Hoyt | |
| 2,549,724 | A | * | 4/1951 | Tinnerman | 70/370 |
| 2,573,061 | A | * | 10/1951 | Raymond | 70/81 |
| 2,629,248 | A | * | 2/1953 | Burdick | 70/370 |
| 2,633,011 | A | * | 3/1953 | Poupitch | 70/370 |
| 2,719,423 | A | * | 10/1955 | Hammerly | 70/81 |
| 2,775,111 | A | | 12/1956 | Savage | |
| 3,446,046 | A | * | 5/1969 | Randel | 70/370 |
| 3,482,422 | A | | 12/1969 | Cornwell, Jr. | |
| 3,589,152 | A | * | 6/1971 | Glass | 70/81 |
| 3,774,420 | A | * | 11/1973 | Orr | 70/104 |
| 3,824,817 | A | | 7/1974 | Orr | |
| 3,868,836 | A | * | 3/1975 | La Roche | 70/240 |
| 3,889,498 | A | | 6/1975 | Harrell | |
| 4,099,397 | A | | 7/1978 | Dauenbaugh | |
| 4,296,617 | A | | 10/1981 | Campagna | |
| 4,312,558 | A | | 1/1982 | Duerr et al. | |
| 4,676,081 | A | | 6/1987 | Craig | |
| 4,761,906 | A | | 8/1988 | Guevara | |
| 4,761,978 | A | * | 8/1988 | Walla | 70/367 |
| 4,882,919 | A | | 11/1989 | Craig | |
| 4,914,932 | A | * | 4/1990 | Walla | 70/367 |
| 5,046,340 | A | | 9/1991 | Weinerman et al. | |
| 5,056,344 | A | * | 10/1991 | Bartczak | 70/381 |
| 5,297,405 | A | * | 3/1994 | Manning et al. | 70/208 |
| 5,435,159 | A | * | 7/1995 | Ramsauer | 70/370 |
| 5,678,437 | A | * | 10/1997 | Walla | 70/370 |
| 5,689,980 | A | | 11/1997 | Weinerman et al. | |
| 5,730,011 | A | * | 3/1998 | Terai | 70/186 |
| 6,094,950 | A | * | 8/2000 | Maynard et al. | 70/81 |

FOREIGN PATENT DOCUMENTS

| | | | | | |
|---|---|---|---|---|---|
| GB | 2120311 | A | * | 5/1983 | 70/370 |

OTHER PUBLICATIONS

"Herman Miller to debut new Passage™ furniture line," Herman Miller, Inc. Bulletin, May 1998.

* cited by examiner

*Primary Examiner*—Robert J. Sandy
*Assistant Examiner*—Carlos Lugo
(74) *Attorney, Agent, or Firm*—Brinks Hofer Gilson & Lione

(57) ABSTRACT

A lock mechanism includes a lock housing having an upper surface with a pair of opposing L-shaped ears, a lower surface with a pair of opposing L-shaped ears, and a front surface with an orifice therethrough. A lock plug cylinder has a face with a key slot therethrough, the lock plug cylinder received within the lock housing through the orifice in the front face. A mounting bracket has a front face with an orifice, a pair of laterally disposed flanges projecting from the front face, and a pair of retaining flanges projecting substantially perpendicularly from the front face. The lock housing is received between the retaining flanges in such a way as to have the retaining flanges received by respective upper and lower opposing ears.

32 Claims, 2 Drawing Sheets

STORAGE LOCK MECHANISM

This application claims the benefit of U.S. Provisional Application No. 60/138,122, filed Jun. 7, 2000, which application is hereby incorporated herein by reference.

FIELD OF THE INVENTION

The invention relates to a storage lock mechanism and, more particularly, to a storage lock mechanism having a lock plug cylinder that is flush with the surrounding surface area.

BACKGROUND OF THE INVENTION

Typical desks and storage cabinets have lock mechanisms in order to secure various items therein. Storage cabinets and desks both come in various styles and configurations. A conventional lock used with such products has a large protruding bezel. Such a lock is typically received in a special-sized hole in the product and is retained with a nut threaded onto the back of the lock behind an exposed face thereof. Retaining the lock to the product in such a fashion captures the front face between the lock bezel and the nut. The special-sized hole prevents the lock from rotating with respect to the hole when the lock is actuated with a key. If the product is made of wood, a plate is typically specially manufactured with the special-sized hole therein and the lock, along with the plate, is mounted to the wood door, the plate preventing the lock from rotating when actuated by the key.

In order to enhance the aesthetic appeal of such conventional office products, with particular respect to the lock mechanism appearance, it is preferred that the face of the lock plug cylinder of the lock mechanism be flush with the visible surrounding surface. Making the lock plug cylinder face flush with the surrounding surface of the product, however, may require elimination of the protruding bezel. The bezel, however, is typically necessary to prevent rotation of the lock housing when the lock plug cylinder is actuated with a key.

SUMMARY OF THE INVENTION

A lock mechanism includes a lock housing having an upper surface with a pair of opposing L-shaped ears, a lower surface with a pair of opposing L-shaped ears, and a front surface with an orifice therethrough. A lock plug cylinder has a face with a key slot therethrough, the lock plug cylinder received within the lock housing through the orifice in the front face. A mounting bracket has a front face with an orifice, a pair of laterally disposed flanges projecting from the front face, and a pair of retaining flanges projecting substantially perpendicularly from the front face. The lock housing is received between the retaining flanges in such a way as to have the retaining flanges received by respective upper and lower opposing ears.

These and other advantages of the invention will appear more fully from the following description in conjunction with the accompanying drawings wherein like reference characters refer to the same or similar parts throughout the several views.

DESCRIPTION OF THE PREFERRED EMBODIMENT

Figure 1:
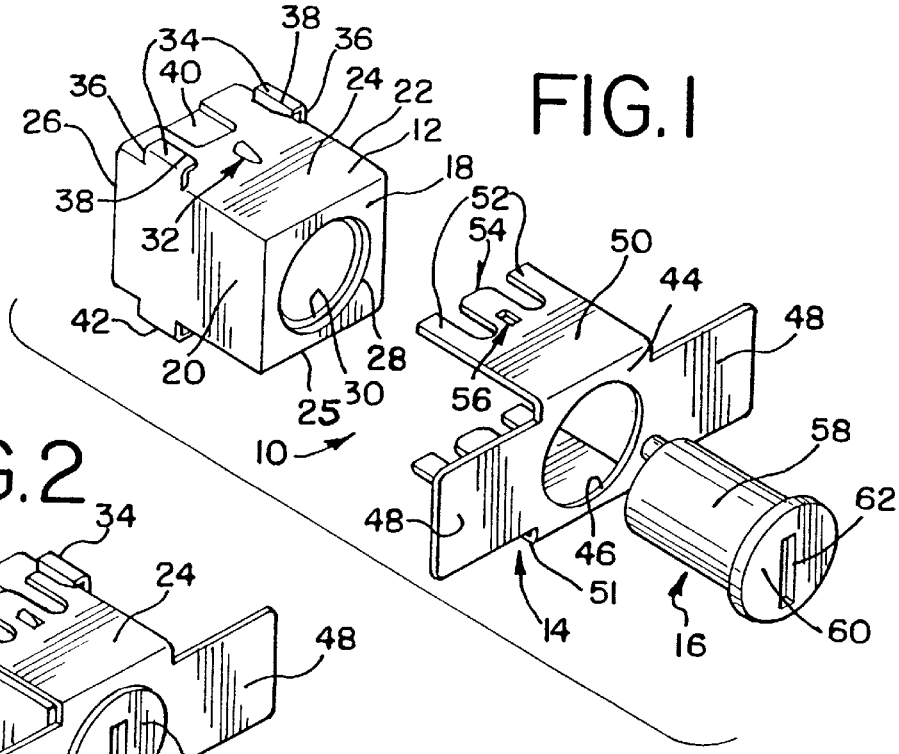
FIG. 1 is an exploded perspective view of a storage lock mechanism according to the present invention.
Figure 2:
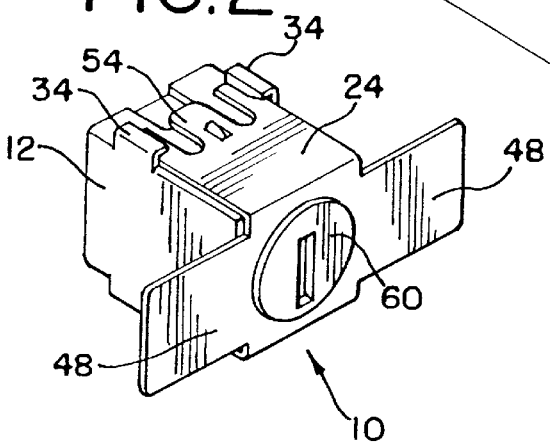
FIG. 2 is a perspective view of a storage lock mechanism according to the present invention.

There are many types of storage products that use a storage lock mechanisms according to the present invention, including storage cabinets as well as desks for example. These storage products can be fabricated from a variety of materials, including metal and wood. Therefore, it is preferable to have a storage lock mechanism 10 that is adapted to be mounted to a variety of storage products that differ not only in style and configuration, but also in material. One such storage lock mechanism 10, as shown in FIG. 1, includes a lock housing 12, a mounting bracket 14 and a lock plug cylinder 16.

The lock housing 12 has a front face 18, a left and right side face, 20 and 22 respectively, an upper and lower face; 24 and 25 respectively, and a rear face 26. The front face 18 has an orifice 28 with an annular rim 30 that forms a shoulder. The upper surface 24 has a retention ramp 32 that is angled upward from the front to the rear face, 18 and 26 respectively. The upper surface 24 also has a pair of symmetrically opposite L-shaped ears 34 laterally disposed thereon. More specifically, each ear 34 has a vertical wall 36 in substantially the same plane as a respective left and right face, 20 and 22, and a horizontal wall 38, substantially parallel to the upper face 24. Each horizontal wall 38 is directed toward the retention ramp 32 and in the opposite direction of the opposing horizontal wall. The upper face 24 also has a recess 40 adjacent the rear face 26 and centered about a longitudinal axis of the housing 12. More specifically, the recess 40 sits in a plane a predetermined distance lower than the plane of the upper face 24 and is of sufficient size to receive a flat instrument such as the head of a screwdriver (not shown). The lower surface 25 also has a pair of ears 42 that are symmetrically opposite the pair of ears 34 disposed on the upper face 24.

The mounting bracket 14 has a front face 44 with an orifice 46. The orifice 46 of the mounting bracket 14 is preferably substantially the same size as the orifice of the lock housing 12. The front face 44 has a pair of laterally extending flanges 48 projecting therefrom in substantially the same plane as the front face 44. Each flange 48 is substantially rectangular in shape and is approximately the same size as the front face 44. The front face 44 also has a pair of upper and lower retaining flanges, 50 and 51 respectively. Each retaining flange, 50 and 51, extends substantially perpendicularly from the front face 44 and projects substantially rearwardly with respect to the front face 44. Each retaining flange 50 has a pair of laterally disposed retaining tongues 52, a centrally disposed release tongue 54, and a centrally disposed retaining hole 56. The mounting bracket 14 is preferably a sheet metal stamping and is a material with sufficient resiliency so as to allow the release tongue 54 to flex and return to its original position.

The lock plug cylinder 16 has a cylindrically shaped barrel 58, a head portion 60 having a diameter a predetermined degree greater than the diameter of the barrel 58. The head portion 60 has a key slot 62.

In assembly, the mounting bracket 14 is placed over the front face 18 of the lock housing 12 by sliding the upper and lower retaining flanges, 50 and 51, over respective upper and lower surfaces, 24 and 25, of the lock housing 12. Sliding the mounting bracket 14 from the front face 18 to the rear face 26 of the lock housing 12 brings the release tongue 54 into contact with the retention ramp 32. The release tongue 54 is upwardly displaced by the retention ramp 32 until the retaining hole 56 is reached, at which point the release tongue 54 returns to its initial position with the retention ramp 32 projecting through the retaining hole 56. Furthermore, the retaining tongues 52 are received by a respective ear 34 of the lock housing 12. The lock plug cylinder 16 is received within the orifice 28 of the lock housing 12 with the head portion 60 abutting against the annular rim 30.

Figure 5:
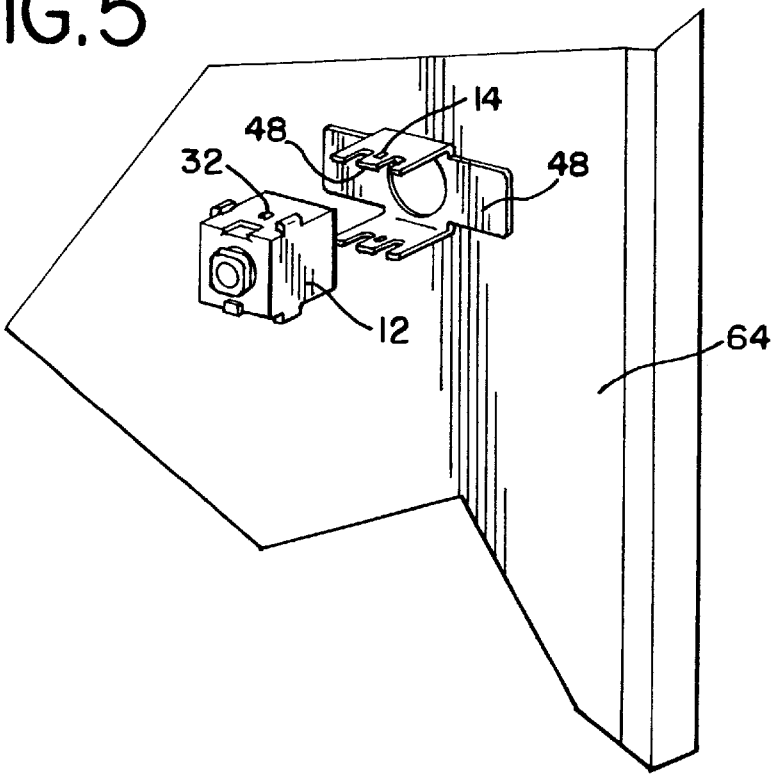
FIG. 5 is an exploded perspective view of a storage lock mechanism in relation to a mounting surface according to the present invention.

As shown in FIG. 5, the flanges 48 are adapted to mate against a metallic rear face 64 of a cabinet, desk or the like. The flanges 48 are resistance spot welded to the metallic rear face 64 in conventional fashion. The engagement of the retaining tongues 52 of the mounting bracket 14 with the ears 34 of the lock housing 12 prevent rotational movement of the lock housing 12 with respect to the mounting bracket 14. Furthermore, engagement of the retention ramp 32 with the retaining hole 56 advantageously prevents linear travel of the housing 12 with respect to the mounting bracket 14. In order to remove the lock housing 12 and lock plug cylinder 16 from the mounting bracket 14, an instrument with a flattened head is inserted between the release tongue 54 of the mounting bracket 14 and the recess 40 of the lock housing 12. By upwardly levering the instrument the retaining hole 56 is cleared of the retention ramp 32 at which time the lock housing 12 and lock plug cylinder 16 may be removed therefrom.

Figure 3:
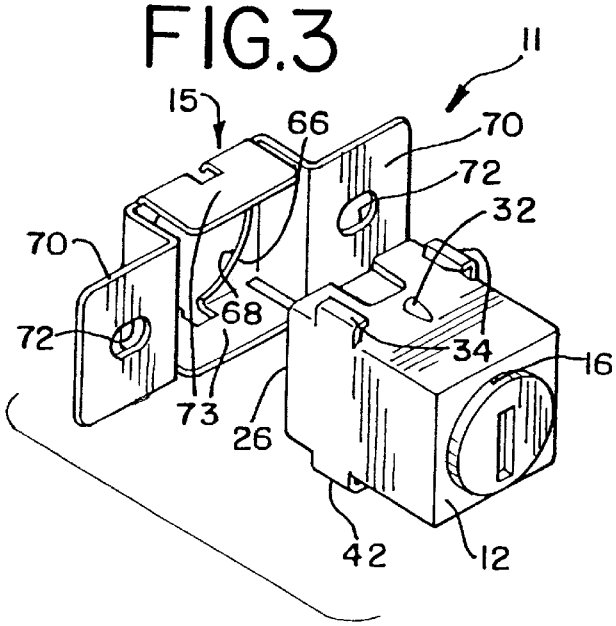
FIG. 3 is an exploded perspective view of a storage lock mechanism according to an alternative embodiment of the present invention.
Figure 4:
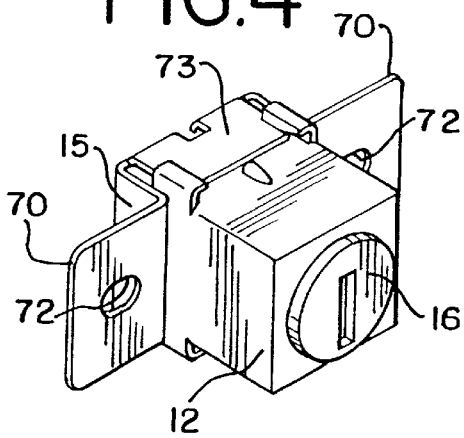
FIG. 4 is a perspective view of a storage lock mechanism according to an alternative embodiment of the present invention.

With reference to FIG. 3, an alternative embodiment of a lock mechanism 11 is shown for a wooden storage product. The lock housing 12 and lock plug cylinder 16 are advantageously the same as the lock mechanism 10 with only the mounting bracket 15 being different, thereby saving on part cost. The mounting bracket 15 has a front face 66 with an orifice 68 centrally disposed therein. The front face 66 has a pair of L-shaped laterally disposed mounting flanges 70 projecting therefrom. Each mounting flange 70 has a portion substantially parallel to the front face 66 with an obround hole 72 disposed therein. The front face 66 also has a pair of planar retaining flanges 73 perpendicularly projecting from upper and lower edges thereof.

Figure 6:
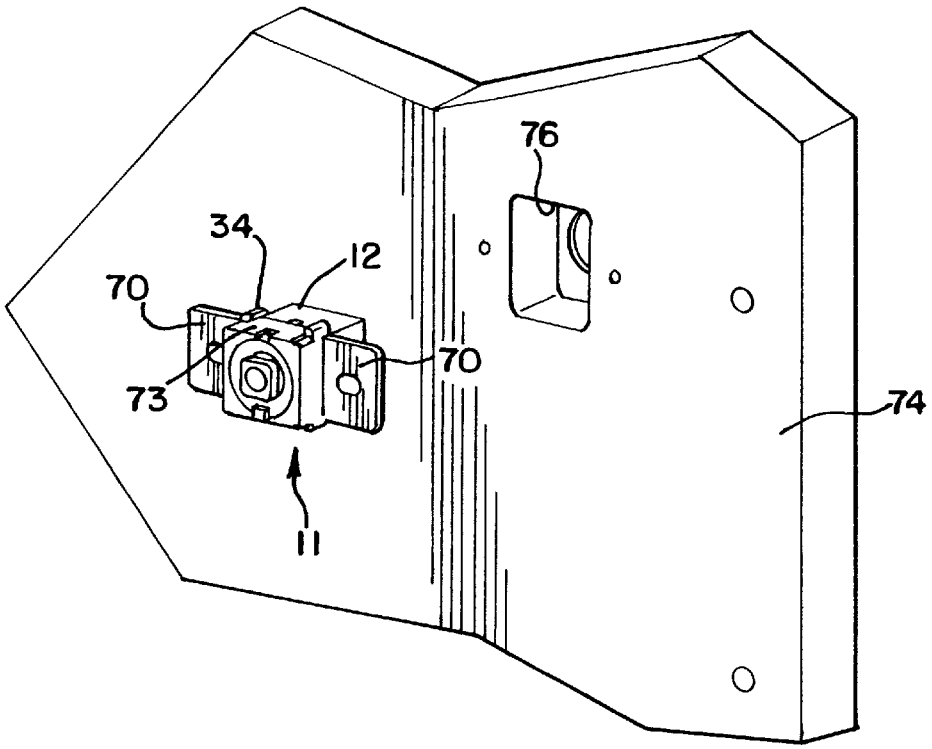
FIG. 6 is an exploded perspective view of a storage lock mechanism with respect to a mounting surface according to an alternative embodiment of the present invention.

In assembly, the mounting bracket 15 is slid over the rear face 26 of the lock housing 12 whereby the retaining flanges 73 are received by ears 34. As shown in FIG. 6, the lock mechanism is then attached to a wooden rear 20 face 74 of a storage product by sliding the lock housing 12 into a substantially rectangular hole 76 therein. The housing 12 is slid into the hole 76 until the mounting flanges 70 mate up against the rear surface 74. The lock mechanism 11 is then mounted to the rear face 74 by driving a standard fastener through the holes 72 in the mounting flanges 70 with a standard fastener such as a screw (not shown). Mounting the bracket 15 to the rear face 26 in such a fashion prevents linear travel of the lock housing 12 with respect to the mounting bracket 15. Furthermore, the retaining flanges 73 received by the ears 34 and 42 of the lock housing 12 prevents rotational movement of the lock housing 12 with respect to the mounting bracket 15.

While the preferred embodiments of the present invention have been described, it should be understood that various changes and adaptations and modifications might be made without departing from the spirit of the invention and the scope of the appended claims.

We claim:

1. A lock mechanism comprising:

a lock housing having an upper surface with a pair of opposing L-shaped ears, a lower surface with a pair of opposing L-shaped ears, and a front surface with an orifice therethrough;

a lock plug cylinder having a face with a key slot therethrough, the lock plug cylinder received within the lock housing through the orifice in the front surface; and a mounting bracket having a front face with an orifice, a pair of laterally disposed flanges protruding from the front face, and a pair of retaining flanges projecting substantially perpendicularly and rearwardly with respect to the front face, each retaining flange having laterally disposed retaining tongues, the lock housing received between the retaining flanges wherein the retaining tongues of each retaining flange are received by said respective upper and lower opposing ears of said lock housing.

2. A lock mechanism comprising:

a lock housing having an upper surface with a pair of opposing L-shaped ears, a lower surface with a pair of opposing L-shaped ears, and a front surface with an orifice therethrough;

a lock plug cylinder having a face with a key slot therethrough, the lock plug cylinder received within the lock housing through the orifice in the front surface; and a mounting bracket having a front face with an orifice, a pair of laterally disposed flanges protruding from the front face, and a pair of retaining flanges projecting substantially perpendicularly and forwardly with respect to the front face, the lock housing received between the retaining flanges wherein the retaining flanges are received by said respective upper and lower opposing ears of said lock housing.

3. A lock assembly comprising:

a wall having an inner face and an outer face;

a lock housing comprising an L-shaped ear forming a guide channel; and a mounting bracket secured to said inner face of said wall;

wherein said mounting bracket comprises a retaining flange, wherein said retaining flange is received in said guide channel, and wherein one of said lock housing and said mounting bracket comprises a protuberance and the other of said lock housing and said mounting bracket has an opening, wherein said protuberance is removeably received in said opening such that said lock housing is releasably connected to said mounting bracket with a snap-fit engagement.

4. The invention of claim 3 further comprising a lock plug cylinder having a face with a key slot therethrough, said lock plug cylinder disposed in said lock housing with said face being substantially flush with said outer face of said wall.

5. The invention of claim 3 wherein said mounting bracket comprises a mounting flange secured to said inner face of said wall.

6. The invention of claim 3 wherein said protuberance comprises a retention ramp.

7. The invention of claim 3 wherein said protuberance is disposed on said lock housing and wherein said opening is formed in said mounting bracket.

8. The invention of claim 3 wherein said lock housing does not extend outwardly beyond said outer face of said wall.

9. The invention of claim 3 wherein said protuberance is disposed on said lock housing and wherein said opening is formed in said mounting bracket.

10. The invention of claim 3 wherein said mounting bracket and said lock housing do not extend outwardly beyond said outer face of said wall.

11. A lock assembly comprising:

a wall having an inner face and an outer face;

a lock housing comprising an L-shaped ear forming a guide channel extending substantially perpendicular to said inner face of said wall; and a mounting bracket secured to said inner face of said wall, said mounting bracket comprising a retaining flange received in said guide channel of said lock housing.

12. The invention of claim 11 wherein said lock housing is disposed between said mounting bracket and said wall.

13. The invention of claim 11 wherein one of said lock housing and said mounting bracket comprises a protuberance and the other of said lock housing and said mounting bracket has an opening, wherein said protuberance is removeably received in said opening such that said lock housing is releasably connected to said mounting bracket with a snap-fit engagement.

14. The invention of claim 13 wherein said protuberance comprises a retention ramp.

15. The invention of claim 13 wherein said protuberance is disposed on said lock housing and wherein said opening is formed in said mounting bracket.

16. The invention of claim 11 further comprising a lock plug cylinder having a face with a key slot therethrough, said lock plug cylinder disposed in said lock housing with said face being substantially flush with said outer face of said wall.

17. The invention of claim 11 wherein said mounting bracket comprises a mounting flange secured to said inner face of said wall.

18. The invention of claim 11 wherein said lock housing comprises a plurality of guide channels.

19. The invention of claim 18 wherein said mounting bracket comprises a plurality of retention flanges received in said plurality of guide channels of said lock housing.

20. The invention of claim 11 wherein said mounting bracket and said lock housing do not extend outwardly beyond said outer face of said wall.

21. A method for assembling a lock assembly comprising:

providing a wall having an inner face and an outer face, a lock housing comprising an L-shaped ear defining a guide channel extending substantially perpendicular to said inner face of said wall, and a mounting bracket comprising a retaining flange;

inserting said retaining flange into said guide channel of said lock housing; and mounting said mounting bracket to said inner face of said wall.

22. The invention of claim 21 wherein one of said lock housing and said mounting bracket comprises a protuberance and the other of said lock housing and said mounting bracket has an opening, and further comprising disposing said protuberance in said opening and thereby releasably connecting said mounting bracket and said lock housing with a snap-fit engagement.

23. The invention of claim 22 wherein said protuberance comprises a retention ramp.

24. The invention of claim 21 wherein said lock housing comprises a plurality of guide channels and wherein said mounting bracket comprises a plurality of retaining flanges.

25. The invention of claim 21 wherein said mounting bracket and said lock housing do not extend outwardly beyond said outer face of said wall after said mounting said mounting bracket to said inner face of said wall.

26. The invention of claim 22 wherein said protuberance is disposed on said lock housing and wherein said opening is formed in said mounting bracket.

27. A method of assembling a lock assembly comprising:

providing a wall having an inner face and an outer face, a lock housing, and a mounting bracket, one of said lock housing and said mounting bracket comprising a protuberance and the other of said lock housing and said mounting bracket having an opening;

securing said mounting bracket to said inner face of said wall; and disposing said protuberance in said opening and thereby releasably connecting said lock housing to said mounting bracket with a snap-fit engagement; and wherein said lock housing comprises an L-shaped ear defining a guide channel and wherein said mounting bracket further comprises a retention flange, and further comprising inserting said retention flange into said guide channel as said protuberance is disposed in said opening.

28. The invention of claim 27 wherein said lock housing comprises a plurality of guide channels and wherein said mounting bracket comprises a plurality of retention flanges inserted into said plurality of guide channels.

29. The invention of claim 27 further comprising removing said protuberance from said opening and disengaging said lock housing from said mounting bracket.

30. The invention of claim 29 wherein said lock housing is disengaged from said mounting bracket without unsecuring said mounting bracket from said inner face of said wall.

31. The invention of claim 27 wherein said protuberance is disposed on said lock housing and wherein said opening is formed in said mounting bracket.

32. The invention of claim 27 wherein said mounting bracket and said lock housing do not extend outwardly beyond said outer face of said wall after said mounting said mounting bracket to said inner face of said wall.

* * * * *